US008561622B1

(12) United States Patent
Sanchez

(10) Patent No.: US 8,561,622 B1
(45) Date of Patent: Oct. 22, 2013

(54) MAKE-UP APPLICATOR PAD

(75) Inventor: Lourdes A. Sanchez, Miami, FL (US)

(73) Assignee: LAS Innovations Corporation, Miami, FL (US)

( * ) Notice: Subject to any disclaimer, the term of this patent is extended or adjusted under 35 U.S.C. 154(b) by 0 days.

(21) Appl. No.: 13/299,505

(22) Filed: Nov. 18, 2011

(51) Int. Cl.
*A45D 40/26* (2006.01)
*A45D 40/30* (2006.01)

(52) U.S. Cl.
USPC ..... 132/319; 132/320

(58) Field of Classification Search
USPC ..... 132/319, 285, 320; 602/52, 7, 74
See application file for complete search history.

(56) References Cited

U.S. PATENT DOCUMENTS

| | | | | |
|---|---|---|---|---|
| 1,850,540 A | | 3/1932 | Erickson | |
| 2,695,622 A | * | 11/1954 | Herod et al. | 132/319 |
| 4,807,650 A | | 2/1989 | Bliss | |
| 5,050,624 A | | 9/1991 | Kobe et al. | |
| 5,052,417 A | | 10/1991 | Cordova | |
| D467,034 S | | 12/2002 | Jaggers | |
| 2009/0151744 A1 | | 6/2009 | Villanueva | |
| 2010/0018545 A1 | | 1/2010 | Franklin et al. | |
| 2010/0154813 A1 | | 6/2010 | Deeds | |
| 2010/0282269 A1 | | 11/2010 | Uchida et al. | |
| 2011/0088716 A1 | * | 4/2011 | Villanueva | 132/319 |
| 2012/0266911 A1 | * | 10/2012 | Haman et al. | 132/319 |

FOREIGN PATENT DOCUMENTS

| | | |
|---|---|---|
| GB | 2398238 A | 8/2004 |
| GB | 2436523 A | 10/2007 |

* cited by examiner

*Primary Examiner* — Rachel Steitz
(74) *Attorney, Agent, or Firm* — Albert Bordas, P.A.

(57) ABSTRACT

A make-up applicator pad made of a flexible material and including an upper portion and a lower portion. The upper portion has a concave upper edge, an exterior face and an interior adhesive face. The lower portion has an exterior face and an interior adhesive face. Interior adhesive faces are of a non-toxic material. Upper and lower protective covers removably cover upper and lower interior adhesive faces when the make-up applicator pad is not in use. The concave upper edge has a cooperative concave shape, to be placed adjacent to the lower eyelid of a person. In use, the upper protective cover is removed and the concave upper edge is placed below the lower eyelid of a person. Then, the lower portion protective cover is removed to secure make-up applicator pad in place. When done applying the make-up, the user peels make-up applicator pad off from the face.

14 Claims, 2 Drawing Sheets

MAKE-UP APPLICATOR PAD

BACKGROUND OF THE INVENTION

1. Field of the Invention

The present invention relates to make-up accessories, and more particularly, to a make-up applicator pad.

2. Description of the Related Art

Applicant believes that one of the closest references corresponds to U.S. Patent Application Publication Numbers 20110088716 A1 and 20090151744 A1, published on Apr. 21, 2011 and Apr. 21, 2011, respectively, to Villanueva for Under-Eye Makeup Shield. However, it differs from the present invention because Villanueva teaches a makeup shield patch of material that is curved at the top to fit under the eye. The front of the patch has a textured surface to catch falling eye makeup. The back of the patch has a weak adhesive which is gentle to the skin. Peel-off strips over the back adhesive surface are scored so that a narrow top peel-off strip or two-end peel-off strips are peeled off and the upper attaching portion adhered to the skin under the eye. The bottom part of the peel-off strip is left in place so the shield does not stick to or disturb any makeup on the cheek. A plurality of makeup shields are die-cut from a sheet of tape with a weak skin sensitive adhesive covered by scored peel off strips.

Applicant believes that another reference corresponds to U.S. Pat. No. 5,052,417 B1 issued to Cordova on Oct. 1, 1991 for Eye Shadow Collector. However, it differs from the present invention because Cordova teaches an instrument for collecting eye shadow during cosmetics application. The instrument includes a collector, which collects particles of eye shadow that do not adhere to the eyelids during the application of eye shadow to a subject. The collector also prevents the particles of eye shadow from contacting and adhering to additional areas of the face of the subject. The collector has a U-shaped collecting surface having a face-engaging edge. The U-shaped collecting surface has a width greater than the width of the eye. A handle attached to the collector holds the collector in position underneath the eye of the subject during use. A collector pad is removably mounted on the collector and has substantially the same surface area as the collecting surface of the collector.

Applicant believes that another reference corresponds to U.S. Pat. No. 5,050,624 B1 issued to Kobe, et al. on Sep. 24, 1991 for Disposable Eye Makeup Shield. However, it differs from the present invention because Kobe, et al. teach a disposable eye makeup shield for use during the application of eye makeup being specifically structured to provide a barrier or protective shield over the lower eyelid and areas of the user's face below the eyes, thereby preventing excess makeup from falling thereon or onto the user's clothing during makeup application. The makeup shield includes a flexible, yet rigid interior body forming a frame structure and having an outer convex, arcuate side and an inner concave side, the interior body defining an overall general configuration of the eye makeup shield. The interior body further includes a lower portion and an upper portion having outwardly extending wings and a top edge being specifically curved and configured to conform with the contour of the user's lower eyelid. An outer layer of substantially porous, absorbent material is adhered to the convex outer side of the interior body and an inner, congruent layer of substantially soft material is adhered to the concave inner side of the interior body, the outer porous material being adapted to catch and substantially absorb makeup falling thereon during application. The lower portion of the interior body includes a grasping area to facilitate holding and positioning of the makeup shield in a preferred position against the lower eyelid.

Applicant believes that another reference corresponds to U.S. Pat. No. 4,807,650 B1 issued to Bliss on Feb. 28, 1989 for Make-Up Coverture. However, it differs from the present invention because Bliss teaches a coverture for protecting a portion of the face from make-up during application of the make-up to the face comprises a shield having at least one make-up impervious section and a means for holding the shield adjacent the protected portion of the face during the application of the make-up. Additionally, a method of applying make-up to a first portion of the face comprises the steps of holding a shield adjacent a second portion of the skin to which make-up is not to be applied, applying make-up to the fast portion of the face, and removing the shield from the first portion of the face, wherein the shield has at least one make-up impervious portion.

Applicant believes that another reference corresponds to U.S. Pat. No. 1,850,540 B1 issued to Erickson on Mar. 22, 1932 for Protective Shield. However, it differs from the present invention because Erickson teaches a shield for protecting the eyes, eyelids, skin and parts of the face adjacent to the eyes during the application of a certain makeup fluid to the eyelashes and the eyebrows. The protective shield consists of a flexible card, which may be held in one hand over the part or member, which it is desired to protect, while the treating material is applied with the other hand; the edges of the card being curved in various ways so as to form parts that are applicable in various ways and which will conform to the shape or curvature of the part being treated.

Applicant believes that another reference corresponds to U.S. Pat. No. D467,034 issued to Jaggers on Dec. 10, 2002 for Lower Eyelash Cosmetology Shield. However, it differs from the present invention because Jaggers teaches an ornamental design for a lower eyelash cosmetology shield that is physically different from the present invention.

Applicant believes that another reference corresponds to Patent No. GB 2398238 issued to Donovan, et al. on Aug. 18, 2004 for Disposable and self-adhesive eye make-up shield. However, it differs from the present invention because Donovan, et al. teach a disposable and self adhesive make up shield (a) to be worn below the eye during the application of eye make-up. The shield comprises an absorbent top surface (b) and a self-adhesive strip (d) on the reverse side. The crescent shaped device provides protection for the lower eyelid and areas of the user's face below the eye from excess make-up. These devices are available in stacks, very similar to self-adhesive stationery notelets.

Applicant believes that another reference corresponds to Patent No. GB 2436523 issued to Djellouli on Oct. 3, 2007 for Eye Makeup Shield. However, it differs from the present invention because Djellouli teaches a shield that comprises a patch to be applied to the face, below the eye, whilst applying eye make-up. The device is disposable, hypoallergenic and has two layers; one which will stick to the skin and an outer textile layer which catches" the makeup dust.

Applicant believes that another reference corresponds to U.S. Patent Application Publication No. 20100282269 A1, published on Nov. 11, 2010 to Uchida, et al. for Makeup-Assisting Patch and Makeup Method Using the Patch. However, it differs from the present invention because Uchida, et al. teach a makeup-assisting patch having a layer structure that a pressure sensitive adhesive layer is provided on one surface of a base layer, wherein (1) the base layer is a layer of a polyurethane elastomer having a glass transition temperature of 0 degree C. or lower, (2) the pressure sensitive adhesive layer is an acrylic pressure sensitive adhesive layer composed of a copolymer containing at least one monomer unit selected from the group consisting of an alkyl acrylate and an alkyl methacrylate each having an alkyl group having 8 to 12 carbon atoms in a proportion of 70% by weight or more, and (3) the thickness of the base layer is 1 to 10 .mu.m, the thickness of the pressure sensitive adhesive layer is 1 to 15 .mu.m, and the total thickness of these both layers is 2 to 20 .mu.m.

Applicant believes that another reference corresponds to U.S. Patent Application Publication No. 20100018545, published on Jan. 28, 2010 to Franklin, et at. for Original Eyelash Butterfly Guard. However, it differs from the present invention because Franklin, et al. teaches an original butterfly eyelash guard that is used in the cosmetic field as a skin, eyes, and eyelash disposable shield in the application of eye makeup and/or as a protector during eye makeup removal, eyelash tinting, artificial eyelash extension, permanent makeup tattooing. The eyelash guard molds firmly around the bridge of the nose, fits perfectly under any size of eyes, and secures to both sides of the face, thereby freeing the hands to apply makeup or to perform other procedures as described. Also, it can be used over eyelids.

Applicant believes that another reference corresponds to U.S. Patent Application Publication No. 20100154813 A1, published on Jun. 24, 2010 to Deeds for Makeup Shield. However, it differs from the present invention because Deeds teaches a makeup shield comprising a pliant sheet sufficiently flexible to overlay selected contoured portions of the human body, e.g. around the eyes, and having at least one edge shaped to conform to an important feature of the body portion, e.g. having a concave arcuate edge to closely follow the edge of the eye. The shaped edge allows careful positioning and covering selected areas without contact to areas to be avoided. The makeup shield may be held in place with an adhesive disposed on the shield at the arcuate edge or recessed slightly to permit a protective cover without the presence of the adhesive to change the makeup to be protected.

Other patents describing the closest subject matter provide for a number of more or less complicated features that fail to solve the problem in an efficient and economical way. None of these patents suggest the novel features of the present invention.

SUMMARY OF THE INVENTION

The instant invention is a make-up applicator pad made of a cloth material with at least one edge having a concave shape. Its interior face has an elongated non-toxic adhesive strip section that contours a concave edge, providing protection for the lower eyelid and areas of a user's face below the eye from excess make-up.

It is therefore one of the main objects of the present invention to provide a make-up applicator pad that is made of a cloth material.

It is another object of this invention to provide a make-up applicator pad having at least one edge concave in shape.

It is another object of this invention to provide a make-up applicator pad having an interior face.

It is another object of this invention to provide a make-up applicator pad having an elongated non-toxic adhesive strip section that contours a concave edge.

It is another object of this invention to provide a make-up applicator pad designed to be placed immediately below the lower eyelid of a user.

It is another object of this invention to provide a make-up applicator pad that provides protection for the lower eyelid and areas of a user's face below the eye from excess make-up.

It is another object of this invention to provide a make-up applicator pad that is volumetrically efficient for carrying and storage.

It is yet another object of this invention to provide such a device that is inexpensive to manufacture while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
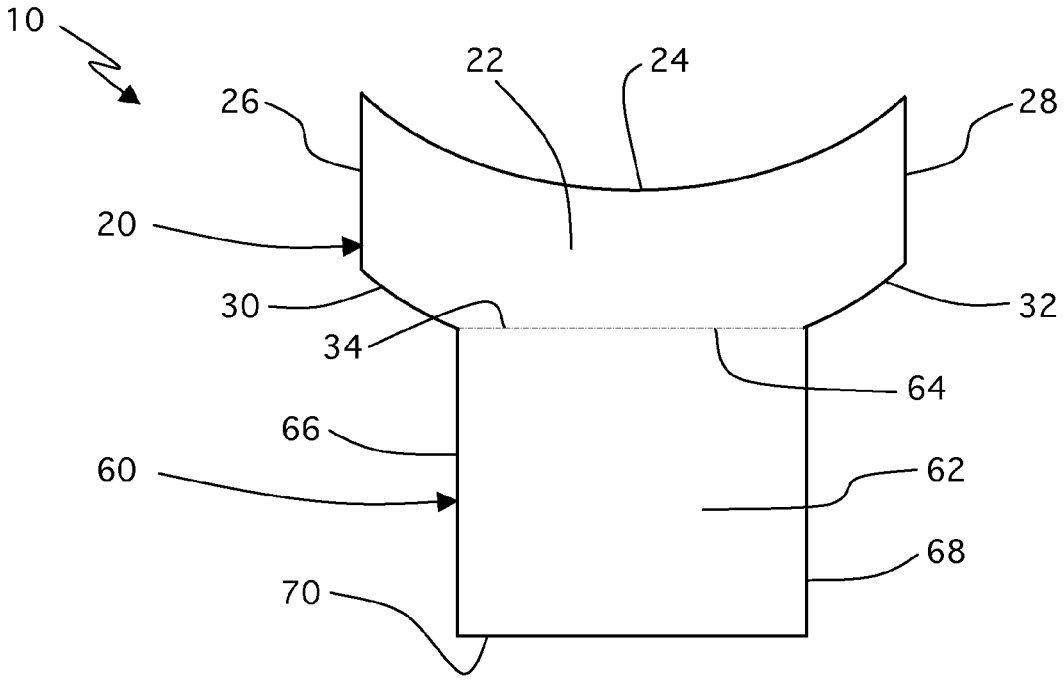
FIG. 1 represents a front elevational view of a make-up applicator pad, object of the instant invention.

Referring now to the drawings, the present invention is generally referred to with numeral 10. It can be observed that it basically includes upper portion 20 and lower portion 60.

Make-up applicator pad 10 is made of a flexible material. Preferably, it is made of a cloth material that is sensitive the skin of a user. Upper edge 24 has a concave shape. Interior adhesive face 36 has an elongated non-toxic adhesive strip section that contours upper edge 24, providing protection for the lower eyelid and areas of a user's face below the eye from excess make-up. Once placed onto a person, make-up applicator pad 10 enables another such as a makeup artist or lay person to use both hands while applying makeup onto the person wearing make-up applicator pad 10. The person wearing make-up applicator pad 10 may also apply makeup her/him self using both hands.

As seen in FIG. 1, upper portion 20 comprises exterior face 22. In the preferred embodiment, upper portion has upper edge 24, lateral edges 26 and 28, and lower exterior edges 30 and 32. Central lower end 34 is defined between lower exterior edges 30 and 32. In the preferred embodiment, lower portion 60 has a substantially square or rectangular shape with exterior face 62. Lower portion 60 has upper end 64, which is common to central lower end 34. Lower portion 60 also has lateral edges 66 and 68 and lower edge 70.

Figure 2:
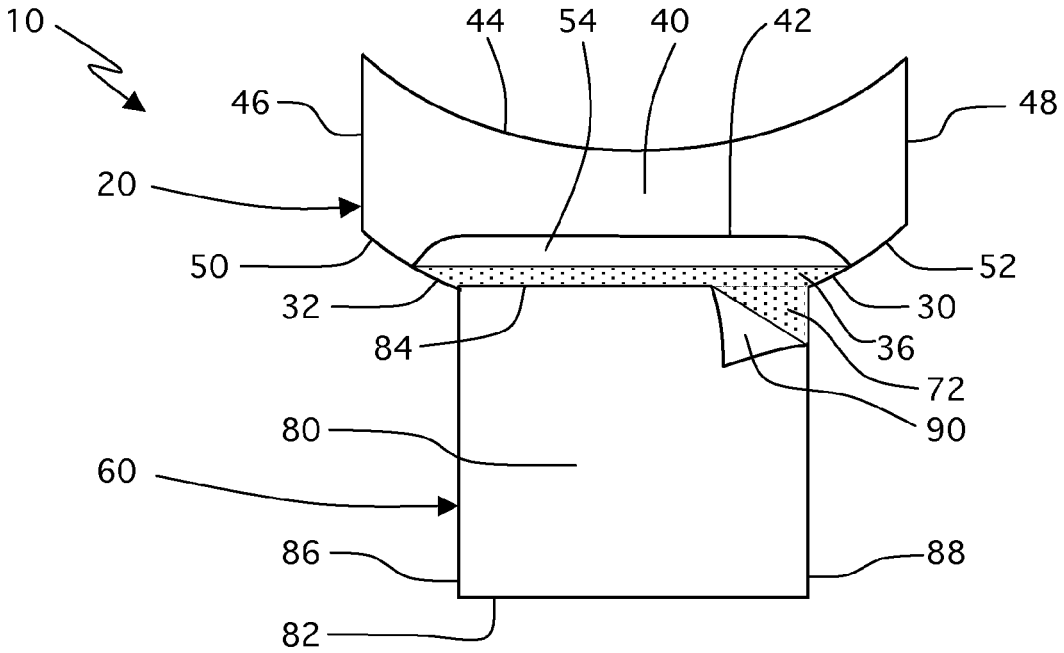
FIG. 2 is a rear elevational view of the make-up applicator pad, showing the protective covers being partially removed from the interior adhesive faces.

As seen in FIG. 2, upper portion 20 further has interior adhesive face 36 that contours concave upper edge 24. Interior adhesive face 36 is of a non-toxic material. Edges 24, 26, 28, 30 and 32 are common to exterior face 22 and interior adhesive face 36. Upper portion protective cover 40 covers interior adhesive face 36 when instant invention 10 is not in use. Upper portion protective cover 40 has lower central edge 42, upper edge 44, lateral edges 46 and 48, and lower edges 50 and 52. Interior face 54 is removably mounted to interior adhesive face 36. Lower portion 60 further has interior adhesive face 72 covered of a non-toxic material. Edges 82, 86, and 88 are common to exterior face 62 and interior adhesive face 72. Lower portion protective cover 80 covers interior adhesive face 36 when instant invention 10 is not in use. Lower portion protective cover 80 has lower edge 82, upper edge 84, lateral edges 86 and 88, and interior face 90. Lower central edge 42 overlaps upper edge 84 or vice-versa to facilitate their removal by a user.

Figure 3:
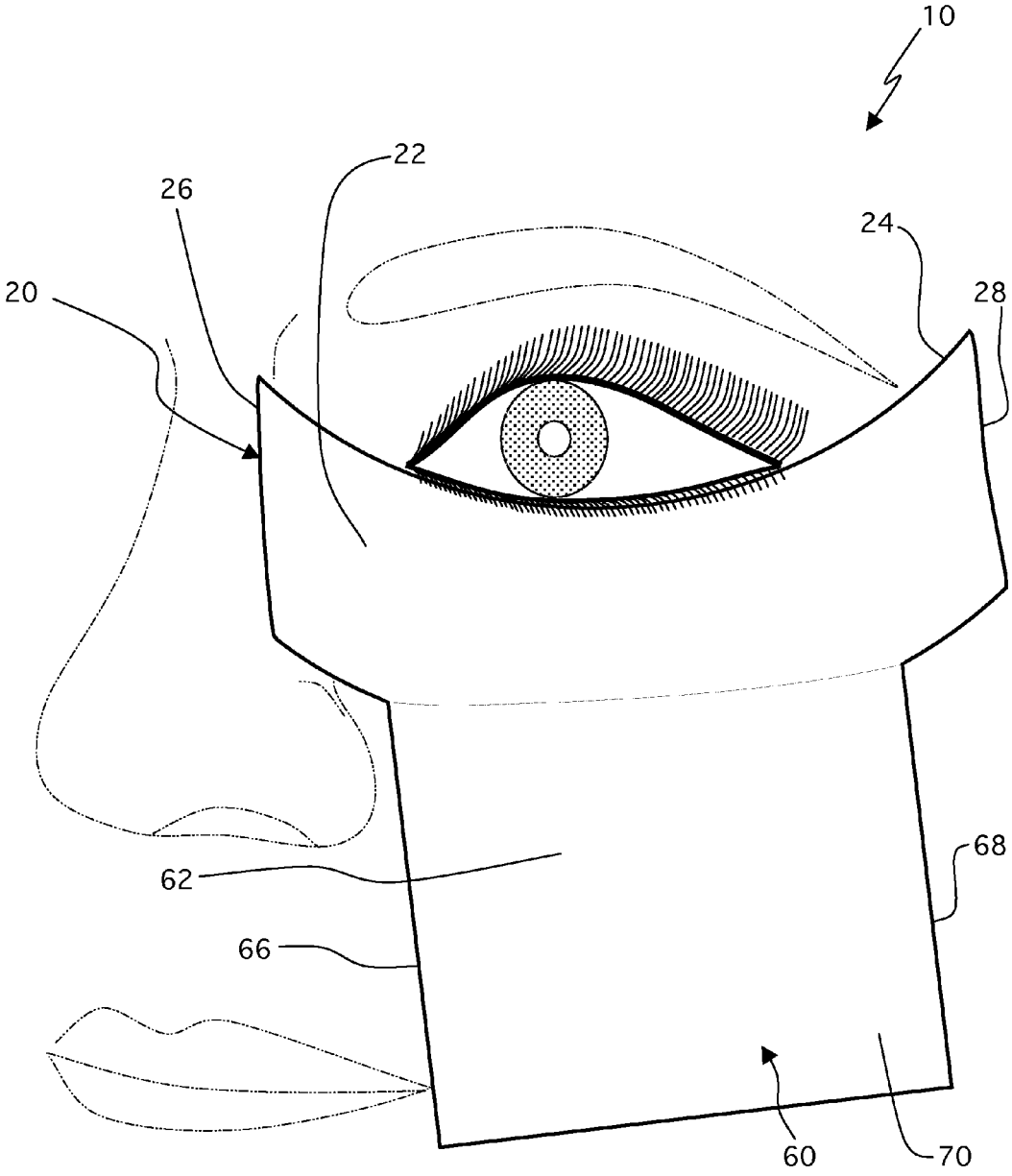
FIG. 3 is a front elevational view of the invention placed adjacent to the lower eyelid of a user.

As seen in FIG. 3, in the preferred embodiment, upper edge 24 has a cooperative concave shape, designed to be placed adjacent to the lower eyelid of a person.

It is noted that the distance between lateral edges 26 and 28 is greater than the distance between lateral edges 66 and 68. Instant invention 10 is symmetrical. In a preferred embodiment, lateral edges 26 and 28 are parallel to each other. In a preferred embodiment, lower edge 70 is perpendicular to lateral edges 66 and 68, and lateral edges 66 and 68 are parallel to each other.

In use, upper portion protective cover 40 is removed and concave upper edge 24 is carefully placed below the lower eyelid of a person. Then, lower portion protective cover 80 may be removed and interior adhesive face 72 is adjusted to secure instant invention 10 remains in place. The makeup artist, lay person, or person wearing make-up applicator pad 10 is then able to place desired make-up around the eye having instant invention 10 thereon, without smearing or affecting onto the area below the eye. When done applying the make-up, instant invention 10 is simply peeled off from his/her face.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A make-up applicator pad, comprising:

A) an upper portion (20) comprising a first exterior face (22) and a first interior adhesive face (36) having common first (24), second (26), third (28), fourth (30) and fifth (32) edges, said upper portion (20) further comprising a central lower end (34), said first edge (24) having a concave shape and extending from said second edge (26) to said third edge (28), said fourth edge (30) extends from said second edge (26) to said central lower end (34), and said fifth edge (32) extends from said third edge (28) to said central lower end (34), said upper portion (20) further comprises a first protective cover (40) that removably covers said first interior adhesive face (36); and B) a lower portion (60) having sixth (66), seventh (68) and eighth (70) edges, said lower portion (60) further having an upper end (64), said upper end (64) being common to said central lower end (34), said lower portion (60) further comprises a second exterior face (62) and a second interior adhesive face (72), said lower portion (60) further comprises a second protective cover (80) that removably covers said second interior adhesive face (72).

2. The make-up applicator pad set forth in claim 1, further characterized in that said first protective cover (40) comprises a ninth (42), tenth (44), eleventh (46), twelfth (48), thirteenth (50) and fourteenth edges (52).

3. The make-up applicator pad set forth in claim 2, further characterized in that said first protective cover (40) further comprises a first interior face (54), said first interior face (54) is removably mounted to said first interior adhesive face (36).

4. The make-up applicator pad set forth in claim 3, further characterized in that said second protective cover (80) further includes fifteen (86), sixteen (88), seventeenth (84), and eighteenth (82) edges and a second interior face (90), said second interior face (90) is removably mounted to said second interior adhesive face (72).

5. The make-up applicator pad set forth in claim 4, further characterized in that said ninth edge (42) of said first protective cover (40) overlaps said seventeenth edge (84) of said second protective cover (80).

6. The make-up applicator pad set forth in claim 4, further characterized in that said seventeenth edge (84) of said second protective cover (80) overlaps said ninth edge (42) of said first protective cover (40).

7. The make-up applicator pad set forth in claim 1, further characterized in that said first (36) and second (72) interior adhesive faces are of a flexible and non-toxic material.

8. A make-up applicator pad, comprising:

A) an upper portion (20) comprising a first exterior face (22) and a first interior adhesive face (36) having common first (24), second (26), third (28), fourth (30) and fifth (32) edges, said upper portion (20) further comprising a central lower end (34), said first edge (24) having a concave shape and extending from said second edge (26) to said third edge (28), said fourth edge (30) extends from said second edge (26) to said central lower end (34), and said fifth edge (32) extends from said third edge (28) to said central lower end (34), said upper portion (20) further comprises a first protective cover (40) that removably covers said first interior adhesive face (36); and B) a lower portion (60) comprising a second exterior face (62) and a second interior adhesive face (72) having common sixth (66), seventh (68) and eighth (70) edges, said lower portion (60) further comprising an upper end (64), said upper end (64) being common to said central lower end (34), said lower portion (60) further comprises a second protective cover (80) that removably covers said second interior adhesive face (72).

9. The make-up applicator pad set forth in claim 8, further characterized in that said first protective cover (40) comprises a ninth (42), tenth (44), eleventh (46), twelfth (48), thirteenth (50) and fourteenth edges (52).

10. The make-up applicator pad set forth in claim 9, further characterized in that said first protective cover (40) further comprises a first interior face (54), said first interior face (54) is removably mounted to said first interior adhesive face (36).

11. The make-up applicator pad set forth in claim 10, further characterized in that said second protective cover (80) further includes fifteen (86), sixteen (88), seventeenth (84), and eighteenth (82) edges and a second interior face (90), said second interior face (90) is removably mounted to said second interior adhesive face (72).

12. The make-up applicator pad set forth in claim 11, further characterized in that said ninth edge (42) of said first protective cover (40) overlaps said seventeenth edge (84) of said second protective cover (80).

13. The make-up applicator pad set forth in claim 11, further characterized in that said seventeenth edge (84) of said second protective cover (80) overlaps said ninth edge (42) of said first protective cover (40).

14. The make-up applicator pad set forth in claim 11, further characterized in that said first (36) and second (72) interior adhesive faces are of a flexible and non-toxic material.

* * * * *